US005769147A

United States Patent [19]

Yanagimoto et al.

[11] Patent Number: 5,769,147

[45] Date of Patent: Jun. 23, 1998

[54] METHOD FOR PRODUCING METALLIC INGOT FOR PLASTIC WORKING

[75] Inventors: Shigeru Yanagimoto; Masashi Fukuda; Yoshiaki Sutou; Takayuki Kato, all of Kitakata, Japan

[73] Assignee: Showa Denko Kabushikikaisha, Tokyo, Japan

[21] Appl. No.: 568,255

[22] Filed: Dec. 6, 1995

[30] Foreign Application Priority Data

Dec. 6, 1994 [JP] Japan ..... 6-330546

[51] Int. Cl.[6] ..... B22D 27/04

[52] U.S. Cl. ..... 164/122.1; 164/126; 164/133

[58] Field of Search ..... 164/122.1, 126, 164/127, 128, 133

[56] References Cited

U.S. PATENT DOCUMENTS

| | | | |
|---|---|---|---|
| 3,485,289 | 12/1969 | Honma . | |
| 3,627,019 | 12/1971 | Hitchchock . | |
| 4,549,598 | 10/1985 | Gervais et al. . | |
| 5,348,071 | 9/1994 | Cook | 164/122.1 X |

FOREIGN PATENT DOCUMENTS

| | | | |
|---|---|---|---|
| 0 243 287 | 10/1987 | European Pat. Off. . | |
| 481 621 | 8/1929 | Germany . | |
| 880 787 | 6/1953 | Germany . | |
| 1 141 753 | 12/1962 | Germany . | |
| 29 11 625 | 10/1979 | Germany . | |
| 46-42308 | 12/1971 | Japan | 164/122.1 |
| 62-227569 | 10/1987 | Japan | 164/122.1 |
| 1 469 422 | 4/1977 | United Kingdom . | |

OTHER PUBLICATIONS

Abstract of Japanese Patent Publication 59–094555 Published May 31, 1984.

Abstract of Japanese Patent Publication 56–50776 Published May 8, 1981.

Solidified Structure of Unidirectionally Solidified Al–Cu Alloys, "Castings", vol. 49, No. 9, 1977, pp. 539–544 by Eui–Pak Yoo, Seiki Nishi and Takeo Shinoda.

*Primary Examiner*—J. Reed Batten, Jr.

*Attorney, Agent, or Firm*—Armstrong, Westerman, Hattori, McLeland & Naughton

[57] ABSTRACT

In a metallic ingot used as a forging stock, high dimensional accuracy, small dispersion of weight, good inner quality, and small radius of meniscus are required. In the metallic ingot fulfilling these requirements, the metallic melt 7 is completely filled the mold comprising a sprue 4 closed after pouring of the melt and is forcedly solidified at its bottom by the cooling plate 1. The crystal grains grow almost parallel to the rising direction of the upper surface of the melt 7. The ingot has no cutting surface on the casting surface.

4 Claims, 11 Drawing Sheets

METHOD FOR PRODUCING METALLIC INGOT FOR PLASTIC WORKING

BACKGROUND OF INVENTION

1. Field of Invention

The present invention relates to a metallic ingot for plastic working and a method for producing the same. More particularly, the present invention relates to forging stock of such as aluminum or the like for cold-forging, hot-forging and closed forging. Metal, to which the present invention can be applied, is non-ferrous metal such as aluminum, zinc and magnesium and the respective alloys, as well as ferrous materials. Metals particularly suited for the ingot of the present invention are aluminum, zinc and magnesium. Aluminum is described hereinafter as a representative metal.

2. Description of Related Art

Usually, an extruded or continuously cast bar is cut to a requisite length and width and is used for forging stock (c.f. Japanese magazine "Alu" July, 1995 published by Light Metal Communication Co., Ltd., Jul. 28, 1995, pages 33 and 34). More specifically, in the case of an extruded bar, aluminum melt is continuously cast to form a small-diameter bar, which is then annealed and scalped. The bar is then cut to a predetermined length or width. A bar having an irregular cross section or a hollow bar may be cut to a predetermined thickness.

A rolled sheet is blanked to a round disc and is used for the forging stock. More specifically, aluminum melt is continuously cast to form rolling stock which is heated and then hot-rolled to form a rolled sheet. It is then blanked by a blanking machine to a predetermined diameter so as to provide the forging stock.

In addition, the melt is directly continuously rolled to a sheet, which is then blanked to provide the forging stock.

The forging stock provided by the above described methods has a cut, machined or plastically worked surface and is hence not an ingot itself, i.e., the cast material entirely having a cast surface.

There are also methods for obtaining an ingot, such as metallic-mold gravity casting, die casting and low- or high-pressure casting and the like. Aluminum melt is poured in a casting apparatus to form an ingot, whose sprue, riser and the like are cut when the ingot is to be forged.

The aluminum Forging Committee organized in The Light Metal Association of Japan carried out research on the so-called "Casting and Forging Method", in which melt is filled in all portions of a mold corresponding to the respective portions of a forging pre-form, and further, solidification speed of the melt in all portions is controlled to an optimum level so as to prevent the defects. This method can be said to be an improvement of the metallic-die gravity casting and die-casting.

However, in order to forge the resultant ingot, the sprue, riser and the like must be cut off (c.f., Alu idem, page 42).

Apart from the above methods, a unidirectional casting is known in the casting of steel (Japanese Unexamined Patent Publication No. 56-50776).

An experimental plant for the unidirectional casting is known in the field of aluminum alloy (c.f., Japanese magazine "Foundry", Vol. 49 (1977), No. 9, pages 539–544). A sketch of the plant is shown in FIG. 2. A mold 2 is placed on the cooling plate 1 provided with a water cooling nozzle 10. The melt 7 poured in the mold is cooled by the cooling plate 1 so as to unidirectionally advance the solidification interface 12 in the direction of the arrow or vertically upward. In FIG. 2, the top cover is denoted by 8. The electric furnace 9 prevents melt 7 and an ingot 6 from being preferentially cooled on the sides.

The cast and then extruded ingot, and the continuously cast and then cut bar have good internal quality but are produced through a complicated process, while requiring considerable man-hours for working. In addition, aluminum scraps are generated in quantity in the course of the production process, with the result that the yield is lowered and hence the production cost increases. However, the total competitive advantage of the extruded material and continuously cast and then cut bar is overwhelmingly higher than the other forging stocks with respect to cost and quality. Extruded material and continuously cast and then cut material account for the majority of the aluminum forging stock.

The cost of forging stock produced by blanking the rolled sheet is high for the reasons as described for the extruded material and the like. Moreover, it is difficult to produce all the forging stock of alloy-grades, whose rolling is difficult.

The direct rolling method has been developed to lower the rolling cost. However, since the direct rolling of high-strength aluminum-alloys is difficult, the applicable alloy grades are more restricted as compared with the ordinary rolling. The direct rolling method is therefore not generaly practical.

The ingots can be produced by a simple process by means of the metallic-mold casting, die-casting, high-pressure or low-pressure casting, and the like. The production cost is therefore low as compared with the continuously cast bar and the wrought materials. The ingots always include, however, such defects as casting cavities, solidification segregation, pin holes, shrink cavities, and oxide inclusions. When solidification advances due to heat withdrawal of a mold, the solidification interfaces advance from all walls of the mold and collide with one another in the final period of the solidification. The impurities, gases and the like are therefore left at a location where the solidification completes and defects generate. Even if an ingot has a simple shape as in the case of a forging stock, it is difficult to take measures to avoid the defects when the thickness is small as compared to the diameter of an ingot because oriented solidification is difficult. Since the cast forging stock, produced by the above described casting methods, has numerous defects, it is difficult to manufacture by such forging stock structural parts which are required to exhibit a particularly high level of mechanical strength and fatigue strength. If such forging stock is applied, it must be strictly inspected for quality, which increases the inspection cost and lessens the yield of product. The total cost of the finished parts is higher than that of the forging stock.

Meanwhile, defects of the unidirectionally cast ingot are few. This ingot has not been used as the forging stock. The present inventors considered whether or not such ingot could be applied for forging.

The quality of a unidirectionally cast ingot is good. However, since the top surface of the melt is open and freely solidifies, the meniscus part of the melt being in contact with the mold is largely curved, and solidifies with curvature R as shown in FIG. 3(*a*). Contrary to this, the extruded bar or continuously cast and then cut bar has a rectangular peripheral surface as shown in FIG. 3(*b*). Since the radius (R) of the meniscus greatly varies depending upon the melt temperature, the pouring method of melt into a mold, vibration of a mold, and the other factors, the shape of an ingot considerably varies. Particularly in the case of die-forging stock, its shape is greatly influenced by the finishing of forgings. When the forging stock is thin or the product has a complicated shape, the influence of meniscus curve on forging is not negligible. Therefore, forging stock having the meniscus must be loaded in a forging die so that the surface having the meniscus is predetermined with either the die bottom or situated above. The loading direction of a forging stock surface must be predetermined in view of influence of the meniscus upon the finishing of forged product. The forging stock cannot therefore be loaded in the forging dies such that the top of ingots may be directed in any direction. Such limitation makes the application of the forging stock impractical.

In addition, it is difficult to control the pouring to a constant amount, with the result that: weight of the forging stocks disperses; the forging machine stops due to overload applied to the same; and, weight and shape of the forged product disperse greatly. It is therefore difficult to produce according to the prior art the forging stock having improved internal quality, high dimensional accuracy and high weight accuracy.

SUMMARY OF INVENTION

It is therefore an object of the present invention to provide a metallic ingot for plastic working, which has such advantages that it: has a high casting yield; is easily poured into a mold; produces a forging stock with small dispersion in weight and a high dimensional accuracy.

In accordance with an object of the present invention, there is provided a metallic ingot for plastic working, such as extrusion, forging forming by rolling, and forming by impactor, at least surface of which ingot is solidified in a mold which is defined by the top, side and bottom surfaces of a mold comprising a sprue closed after pouring of the melt and filling the mold with metallic melt, which ingot consists of, in least in a surface portion thereof, crystal grains growing almost parallel to the rising direction of the upper surface of the melt, and which has no cutting surface on the casting surface.

The mold herein usually indicates a die which contributes to shaping of the metallic melt but does not include the sprue. In the present invention, however, since a plug closes the sprue and the top end of the sprue participates in shaping of the melt, the mold includes the ordinary one and also the top surface of a plug which closes the sprue after the pouring of the melt. The side or lateral portion of a mold herein indicates a portion shaping the outer peripheral portion of an ingot, and, further the outer peripheral portion of a core which shapes the hollow portion of an ingot. The ordinary mold is referred to as the "main mold" in order to distinguish the same from the "mold".

An ingot according to the present invention can be produced by either the top or bottom pouring. In the top pouring, for example, the main mold is located on the cooling plate, i.e., a portion of the mold, in which a mold cavity is defined, melt is filled through a sprue of the mold without leaving a clearance in the mold; the sprue is closed by an openable plug; and, the cooling plate is cooled so as to forcedly cool the metallic melt.

In the bottom pouring, for example, the main mold is located on the upper or lower surface of a cooling plate, i.e., a portion of the mold in which a mold cavity is defined, melt is filled through a sprue of the mold without leaving a clearance in the mold; the sprue is closed by an openable plug; and, the cooling plate is cooled so as to forcedly cool the metallic melt. The descriptions hereinafter is made with regard to the top pouring method.

In the above method, a reservoir of melt may be provided on the top of the mold. The melt in the reservoir is poured into the main mold through the melt inlet so that no clearance is left in the mold. The melt inlet is then closed to intercept the melt in the reservoir from the one in the mold. The melt in the mold is hence cooled while it is intercepted from the melt in the reservoir.

The melt is filled in the mold and solidified to form an ingot (a). The ingot according to the present invention has no cut surface of riser and sprue as the ordinary metallic-die castings have or the continuously cast and then cut bar has. The ingot according to the present invention can therefore be subjected, as it is, to the plastic working process without undergoing the cutting step. However, when the requirement of forging is severe, the ingot can be homogenized to so as to decrease the segregation of solute elements in the metal structure. The ingot can also be annealed to relive the casting stress or to coarsely precipitate the alloying elements and hence to soften the alloy prior to the forging. In addition, an ingot according to the present invention can be subjected to light surface working such as barrel polishing and shot blasting to relieve burrs on an ingot, when the forging accuracy required in the forging is high.

Ingots, which are solidified under the riser effect of the conventional metallic-die casting, the weight of the forging stocks greatly disperses due to cutting inaccuracy of a sprue, riser and the like, as well as due to the draft of a mold. In addition, a disc saw is usually used for cutting a continuously cast bar. Weight dispersion of the cut forging stock depends upon its thickness and is as small as ±2.5% in the case of, for example, a 60 mm diameter and 9 mm thick stock. Weight dispersion of the ingots or forging stocks according to the present invention can be suppressed to a level as low as the cut bar, without relying on cutting.

Requirements for attaining such small weight dispersion are, in the present invention, (a) controlling the pouring amount by means of filling the mold space and hence bringing the melt into contact with the entire inner surface of a mold, and (b) effecting crystal growth in a direction almost parallel to the rising direction of melt is upper surface.

The crystal growth in a particular direction (b) is attained by cooling in one direction, i.e., forced cooling of a portion of a mold. The crystal growth (b) advances the solidification interface to an upper position as high as possible, thereby increasing the proportion of the defect-free metal.

Since the crystal growth in a direction other than the above mentioned one impairs the advantages attained by the feature (b), the former growth should be excluded. However, the crystal growth due to inevitable cooling of melt by the top or sides of a mold is permissible. For example, 20% or less, preferably 10% or less of the width of a flat ingot may consist of crystals grown from each side of a mold. The crystal growth in a particular direction (b) according to the present invention is only one orientation of growth except for the one due to inevitable cooling of a mold.

When the melt, which is filled by the feature (a), solidifies, the solidification shrink may take place somewhat in the top of melt and the solidification surface may be separated from the upper surface of a mold. Since the external shrinkage thus takes place, the free open surface is formed on the top of melt, and the subsequent solidification proceeds on the top of an ingot without being cooled by a mold. Even if such solidification occurs, weight dispersion of forging stock is small. Moreover, such large meniscus as impeding the forging cannot therefore be formed along the edge of an ingot. Specifically, the radius of curvature of the meniscus is 1 mm or less.

The above feature (a) is described more in detail. Desirable conditions to fulfill the feature (a) are as follows. The melt is subjected to pressure which extends the melt into the entire mold cavity without leaving a clearance in the mold. The air is appropriately evacuated from a mold for example through an air vent. The air should be evacuated in proportion to the pouring amount of melt. The melt within the mold should be subjected to a pressure of the melt in a reservoir. When these conditions are fulfilled, the shape of the resultant ingot follows the contour of a mold and can thus have a good shape. It is furthermore desirable that a vertical difference in the melt level in the reservoir and the upper surface of the melt filled in a mold is 30 mm or more.

As is clear from the above descriptions, an ingot having the features (a) and (b) is different from the ingots which are produced by any one of the conventional methods: continuous casting; metallic-die casting; low- or high-pressure casting; and unidirectional solidifying and casting. It is impossible to produce an ingot according to the present invention by means of the other conventional casting methods (c.f., Revised Fifth Edition, Metals Handbook (in Japanese) of pages 1035–1043).

The ingot according to the present invention has also a feature (c) that the top portion of a melt is brought into contact with the closing portion of the sprue, which is closed after pouring the melt therethrough. Since the melt is brought into contact with the inner surface of a mold at least directly after pouring of melt through a sprue according to the feature (c), weight of the melt becomes equal to the product of the volume of the mold cavity and specific gravity of the melt. As a result, the pouring amount becomes constant and hence the weight of an ingot also becomes constant. Excessive pouring of the melt no longer occur.

Since the sprue is closed by an openable plug after pouring of the melt and the front end of the openable plug constitutes a portion of a mold, it is no longer necessary to cut the sprue and also weight dispersion of ingots due to cutting decreases. However, since the cooling of melt starts directly after pouring, the cooling of melt in contact with the openable plug (a portion of a mold) is greatly delayed. The sprue portion of an ingot's surface is as cast but may be left on the ingot surface in the form of a protrusion 30 as shown in FIG. 4 or a concave hollow as shown in FIGS. 17 and 19. Such protrusion 30 or concave hollow can be made nondetectably small, when the openable plug is finished highly accurate, but the forging is not virtually influenced by it, when it is 2 mm or less in depth.

The feature (b), which is related to the metal structure of an ingot, is described in detail.

In the case of top pouring, since the bottom of a mold is forcedly cooled, there is created such an orientation characteristic in that the crystal grains grow vertically upward (i.e., coincident with the rising direction of melt or within a slant angle of within ± approximately 20°, within ±45° at the maximum relative to the vertical line. Although the cooling of the melt from the sides and top of a mold may result in the orientation growth different from the one described above, it is necessarily detected in the ingot according to the present invention.

However, the ingot according to the present invention necessarily comprises oriented crystals which grow from a surface in a direction almost parallel to the rising direction of melt. Also, the ingot cast by bottom pouring comprises the oriented crystals, although its direction of growth is upward or downward depending upon the position of a cooling plate.

The oriented growth mentioned above can be detected by means of the macroscopic structure observation, when the columnar crystals are identified by the observation. If this identification is impossible, the oriented growth can be detected by the polar microscopic observation of a specimen which has been subjected to Barker treatment (anodic oxidation in a 1.8% $HBF_4$ (fluoroboric acid) aqueous solution under a condition of 20–40 V of voltage, 20° C. of liquid temperature, and 1–2 minutes of time). The columnar macroscopic structure can be identified for example in an alloy without-addition of grain-refining agent, and Al—Si alloy having a composition in the vicinity of eutectic or hypereutectic. The columnar structure is not, in most cases, identified for example in an alloy with the addition of grain refining agent, such as Al—Ti alloy or Al—Ti—B alloy, whose orientation growth can be detected by the polar microscopic observation.

In order to intensify the effect of forced cooling, the average DAS (secondary dendrite-arm spacing) value of metal solidified on the forced cooling surface (except for direct proximity to the mold side) is preferably 40 $\mu$m or less. When the forced cooling is carried out to such an extent that the above DAS value is attained, an ingot with excellent inner quality can be produced, that is, one or no casting defect such as micro-porosities, micro-shrinkages and the like 200 $\mu$m or more in size is present per $10^2$ $mm^2$ and ten or fewer cavities from 50 to 200 $\mu$m in size are present per $10^2$ $mm^2$.

Under the orientation growth described above, there occurs a prominent tendency for the DAS to increase in a direction from the forcedly cooled surface (except for the direct proximity of the mold side) to the opposite surface. When the former DAS and the latter DAS are expressed as $d_1$ and $d_2$, respectively, the forced cooling creates a relationship that $d_1<d_2$. However, when 1.1 $d_1<d_2$, the forced cooling includes a condition virtually not effective to prevent the casting defects. On the other hand, when 10.0 $d_1>d_2$, the industrial production of an ingot becomes impractical. A preferred relationship is therefore $d_2$=1.1 $d_1$ to 10.0 $d_1$. The structure having DAS within this range is hereinafter referred to as the "forced cooling structure". More preferably, $d_2$=1.1 $d_1$ to 5.0 $d_1$.

Ratio of proportion of the forced cooling structure increases, when: the degree of forced cooling is identified; the side surfaces of a mold is heat-insulated; and the surface of a mold opposite to the forcedly cooled surface is heat-insulated. Casting defects can be lessened by increasing the proportion of the forced cooling structure. The proportion of the forced cooling structure as seen in a central vertical direction of an ingot is therefore preferably 70% by area or more.

The size (d') of crystal grains observed by a polar optical microscope (hereinafter referred to as the "polar crystal size") is preferably 100 $\mu$m or less in average. There is a prominent tendency that the polar crystal size (d') to decrease in a direction from the forced cooled surface to the surface opposite to the former surface. When the former size and the latter size are expressed as $d'_1$ and $d'_2$, respectively, the forced cooling creates a relationship that $d'_1<d'_2$. However, when 1.05 $d'_1>d_2$, the forced cooling includes a condition virtually not effective to prevent the casting on the other hand, when 7.0 $d'_1<d'_2$, the industrial production of an ingot becomes impractical. A preferred relationship is therefore $d'_2$=1.05 $d'_1$ to 7.0 $d'_1$. The structure having the grain size within this range is hereinafter also referred to as the "forced cooling structure". More preferably, $d_2$=1.05 $d'_1$ to 5.0 $d'_1$. The forced cooling structure is preferably 70% by area or more because of the reasons as described above.

BRIEF DESCRIPTION OF DRAWINGS

FIG. 12(*b*) shows a mold which is provided with liners for air escape.

FIG. 19 is a photograph of macroscopic structure of JIS 2218 alloy (Example 3).

An ingot according to the present invention preferably has a generally flat shape. The upper and lower surfaces of an ingot according to the present invention may be flat or may not be flat as shown in FIGS. 5(*a*), (*b*), (*c*) and (*d*). An irregularly shaped ingot as shown in FIG. 5(*e*) or a three dimensionally irregular ingot may be produced so as to make the shape of an ingot as close as possible to that of the forged product. In addition, an ingot may be locally thick so as to enhance the forging degree at this location and hence to improve the mechanical properties.

The method for producing an ingot according to the present invention is hereinafter described with reference to several drawings.

Figure 1:
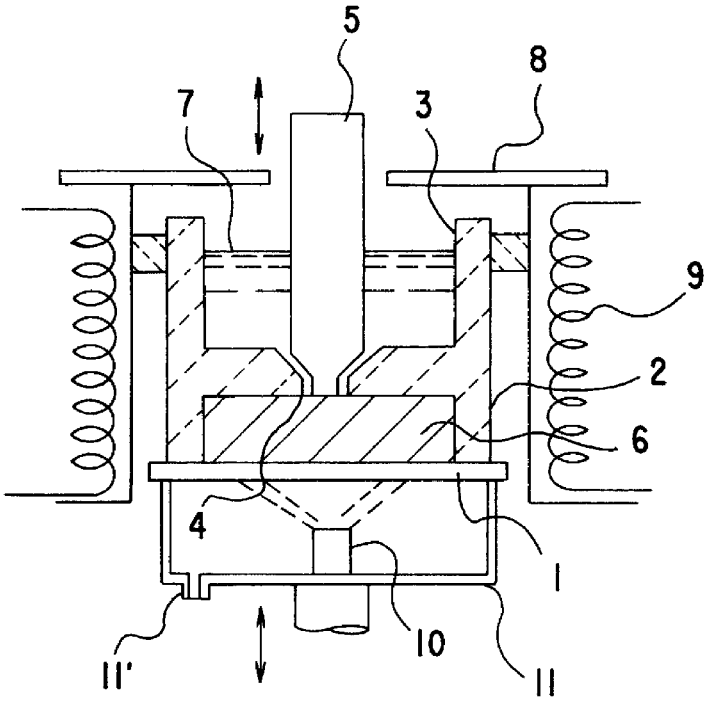
FIG. 1 is a general cross-sectional view of a casting apparatus and illustrates an example of the method for producing an ingot according to the present invention.

Referring to FIG. 1, a main mold 2 is located on the cooling plate 1. A melt reservoir 3 is positioned above the main mold 2 and receives the melt 7 from a melting furnace or the like (not shown). In an embodiment shown in FIG. 1, the bottom of the melt reservoir 3 is integral with the top of the main mold 2. The melt reservoir 3 is communicated with the main mold via the inlet 4 which is provided with an openable plug 5. A vertically driven apparatus (not shown) lifts upwards the openable plug 5 so as to pour the melt and to form an ingot 6 into the main mold 2. The level of melt rises therefore upward. Upon completion of pouring, the openable plug 5 is lowered to shut off the melt. Reference numeral 8 denotes a top cover. An electric furnace 9 is provided so as to maintain a certain temperature of the melt and to moderate the cooling of melt by the side portions of the mold.

The cooling plate 1 is cooled by means of a spray nozzle 10 which is provided beneath the cooling plate 1 and ejects water therethrough. The spray nozzle 10 is mounted and fixed on a tubular case 11 and supports the cooling plate 1. Reference numeral 11' denotes the drain outlet of cooling water. The tubular case 11 is secured to a driving apparatus (not shown) and is vertically displaced together with the cooling plate 1 and the spraying nozzle 10.

The casting method according to the present invention can be carried out as is illustrated, for example as shown in FIG. 1 but is not at all limited to this method. The fundamentals of the casting method according to the present invention reside in the features that: the melt is filled, without any air gap, in a closed mold which is located on the cooling plate; and, the melt is forcedly cooled by the cooling plate.

In the casting method according to the present invention, the main mold may be closed after the melt is poured and then the main mold is filled with the melt. In other words, a portion of the main mold, for example a top portion, may be opened prior to pouring. The pouring method is therefore not limited to the one as illustrated in FIG. 1 but may be varied. Although one inlet 4 is provided on the top central surface of the main mold 2, the position and number of the inlet(s) can be variously selected in accordance with the size and shape of an objective ingot. In addition, an inlet may be provided on the lateral portion of the main mold.

The melt, which is poured into the mold, must be mainly cooled by the cooling plate, while preventing the cooling by the side wall and the like of the mold. The melt is thus forcedly cooled from the bottom toward top portion.

Figure 6A:
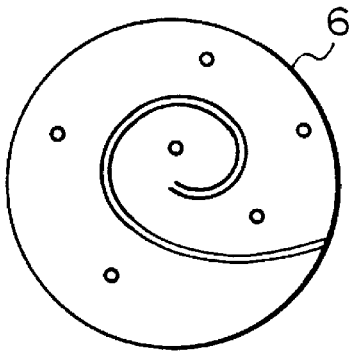
FIGS. 6 (*a*) and (*b*) illustrate the blow formed on an ingot.
Figure 6B:
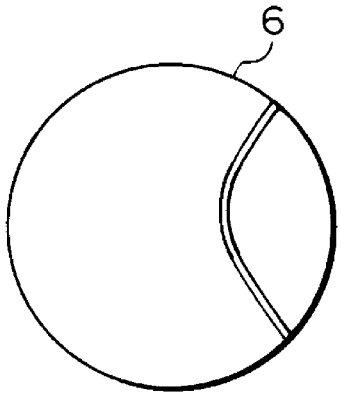

Desirably, the cooling plate has a temperature of 100° C. or more, when the melt is poured into the cavity of a mold, because the blow (cast defects in the form of spots or curves as shown in FIG. 6, usually found in the metal-mold casting) disadvantageously occurs when the pouring is below the above temperature. It is noted that FIGS. 6(*a*) and 6(*b*) illustrate the blow formed on an ingot 6. Preferred highest temperature of the cooling plate, when pouring, is approximately as high as the melt temperature, in the light of cooling efficiency and quality of the castings. Commonly used parting powder can be applied on the surface of a cooling plate, because the parting powder is effective in preventing the blow.

Figure 7:
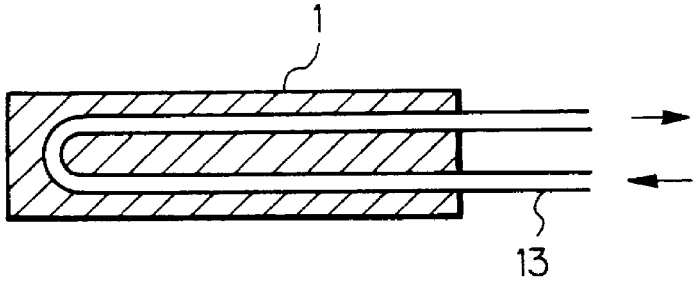
FIG. 7 is a cross-sectional view of a cooling plate and illustrates a cooling method.
Figure 8:
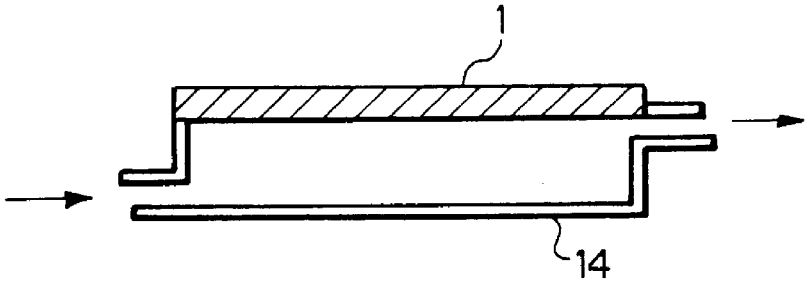
FIG. 8 is a cross-sectional view of a cooling plate and illustrates another cooling method.

According to one of the methods for forcedly cooling the cooling plate, a spray or shower is applied onto the lower surface of a cooling plate. The cooling plate 1 may be cooled by means of conducting water through the cooling-water conduit 13, as shown in FIG. 7, which is defined in the interior of cooling plate 1, or by means of conducting water through a cooling-water tank 14, as shown in FIG. 8, provided beneath the cooling plate 1. Forced cooling of the cooling plate is initiated after pouring of the melt into the main mold and then the cooling plate at a certain temperature. When the cooling plate arrives at another certain temperature to prevent excessive heat-withdrawal from the mold, the forced cooling is stopped. If the forced cooling is further continued, the temperature of a mold is so lowered that it must be heated to a desirable temperature for a long period of time before a subsequent casting is started. After stopping of the forced cooling, the cooling plate is still kept in contact with the ingot until descending down to a certain temperature. The cooling plate is then lowered.

Melt in the mold may be solidified exclusively by forced cooling through the cooling plate.

Alternatively, the cooling may be carried out by a cooling plate and then cooling water directly applied on the bottom of an ingot. That is, the former cooling is interrupted at an incomplete solidification, and, subsequently, a cooling plate is withdrawn from the bottom of an ingot. The directly applied cooling water promotes cooling of an ingot and increases the cooling speed as is described in more detail hereinafter.

Since the solidification speed is high in the vicinity of a cooling plate, the grain size and DAS of a portion in contact with the cooling plate are fine. As the solidification advances and the solidification interface hence is distant from the cooling plate, the solidification speed lowers, because heat conduction through the solidified metal and the contact surface of an ingot with the cooling plate decreases. The mold may be incompletely solidified by the cooling plate, provided that thickness of a solidified shell is so high as not causing the break out. Then, the cooling plate is removed and the cooling water is directly applied on the bottom of an ingot. The directly applied cooling water may be in the form of a spray, shower and the like, capable of accelerating the cooling speed and hence the advancing speed of a solidification interface which is distant from the bottom of an ingot. This method is effective for enhancing the solidification speed and hence to promote the oriented solidification structure. If the cooling plate is removed to apply the cooling water directly onto the bottom of an ingot, the heat withdrawal from an ingot drastically increases to accelerate the cooling speed. The complete solidification in the mold is not necessarily desirable, but the direct cooling by cooling water should be carried out if necessary. This method is particularly effective for an ingot with thick sheet thickness and provides such an ingot with uniform structure from the bottom to top. In addition, this method eliminate a problem encountered in a conventional casting, that is, difficulty in casting of a certain type of an alloy, and enables any type of alloys to be cast to produce castings having good quality.

As is described hereinabove, the pouring of melt is desirably started when the temperature of the cooling plate is at 100° C. or more by means of heating. This heating may be carried out by utilizing heat which the ingot, whose solidification has been completed, retains. That is, when the cooling of a cooling plate is stopped, an ingot cast on the cooling plate is still placed on the cooling plate, so that the heat of the ingot enhances the temperature of cooling plate, while simultaneously accelerating cooling of the ingot.

A temperature-measuring apparatus such as a thermocouple may be inserted into a cooling plate to measure the temperature of the cooling plate. When the temperature of a cooling plate exceeds 100° C., an ingot on the cooling plate can be removed from there. Temperature of a cooling plate changes during the respective steps, such as pouring of melt, cooling of the cooling plate, interruption of cooling-water supply into the cooling plate, holding of an ingot on the cooling plate, and removal of an ingot from the cooling plate. When such temperature change is monitored, the timing to start or finish these steps can be automatically determined. Automatic, continuous and unmanned casting process, which produces ingots with stable quality, can therefore be provided. A temperature-measuring apparatus is provided in at least the cooling plate, and if necessary, also in the top and/or side portion of a mold.

Material used for a cooling plate is metallic material which exhibits excellent refractory property and high coefficient of heat conductivity, such as Cu and Al, and may also be refractory material exhibiting high coefficient of heat conductivity, such as graphite, SiC and $Si_3N_4$.

Figure 9:
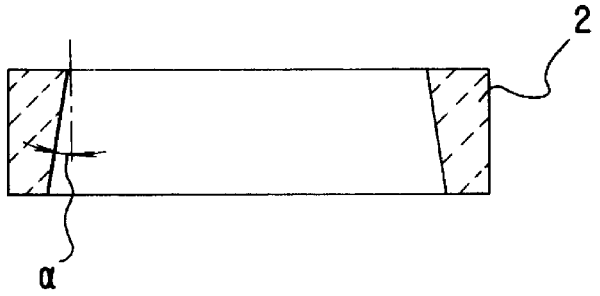
FIG. 9 is a cross-sectional view of a tapered mold.

A main mold 2, which is located on the cooling plate 1, is provided, as shown in FIG. 9, with a draft $\alpha°$ widening downward so as to improve the separation of an ingot from the mold, when an ingot is to be withdrawn downward. This draft $\alpha°$ is preferably less than 5°. When the draft $\alpha°$ is greater than 5°, the top outer diameter becomes considerably greater than the bottom outer diameter of an ingot, so that quality of a forged product is impaired.

When a mold comprises separable, top and side portions, and, further, a cooling plate is provided with knocking pins, the side of the mold is displaced down together with an ingot, and it is then pushed above by the knocking pins. Alternatively, when a vacuum pad is provided, the vacuum pad can be brought into contact with the top surface of an ingot which is then removed from the cooling plate by suction. In these cases, the main mold is preferably provided with a 5° or less draft which is widened downward, i.e., in the direction opposite to the one described above.

Parting powder can be applied on the mold's inner surface so as to smoothly separate an ingot from the mold.

Material, of which the main mold consists, can be ordinary refractory materials; heat-insulative refractory materials mainly composed of SiC, $SiO_2$, $Al_2O_3$, or MgO; such refractory materials as SiC, $Si_3N_4$, graphite, BN, $TiO_2$, $ZrO_2$, AlN or the like alone or in mixture; or such metal as Fe or Cu. One of these materials is selected considering comprehensively the kind of metal or grade of alloy to be cast, temperature, to which the main mold is exposed, wettability of molten metal, corrosion resistance and the like.

A heating means may be mounted on the main mold, which consists of one of the above materials, or the mold may be subjected to external heating by means of an electric furnace or another heating furnace. Preferably, the top of a mold and upper side portion of a mold are preliminarily heated to and maintained at a temperature between the melting point of the cast metal and the temperature of the melt. It is not necessary to heat the main mold consisting of heat-insulative refractory material. The refractory material may however be internally or externally heated so as to assist the insulation effectiveness depending upon its kind. The cooling of a mold herein indicates the withdrawal of heat from the melt, while the mold may be heated to an appropriate temperature to retard the solidification starting from the vicinity of the refractory materials and hence to advantageously promote the unidirectional solidification.

Heating of the main mold is desirably so controlled that the solidification interface becomes as flat as possible. On the contrary, if the melt solidifies in the side portion earlier than in the central portion, it forms a somewhat concave solidification interface. If the temperature of refractory materials of the mold side is higher than the central portion of melt, this portion solidifies earlier than the side portion, so that a somewhat convex solidification interface is formed.

A melt reservoir may be a separate body from the main mold and be positioned the main mold. The melt reservoir may be an integral body with the main mold, as shown in FIG. 1, which thus constitutes a lower portion of the melt reservoir. Material of the melt reservoir may be the same as or different from that of the main mold. Material of the melt reservoir is not limited particularly.

The inlet 4 of melt formed in the main mold 2 is provided with an openable plug 5. The melt 7 can be intermittently supplied from the melt reservoir 3 into the main mold 2 by means of opening and closing the openable plug 5. The pouring of melt, solidification and withdrawal of an ingot can therefore be repeated, thereby enabling ingots to be continuously produced in a constant cycle. The openable plug 5 must ensure supply of the melt into the space of the main mold. In addition, since the lower surface of the openable plug 5 is a portion of the mold wall and is exposed to the mold space, the openable plug must neither deform nor spall. The function of the openable plug 5 is therefore of important significance.

Material exhibiting not only the refractory and heat-insulative properties but also the mechanical properties is therefore selected for the openable plug. For example, such refractory material as SiC, $Si_3N_4$, or a mixture thereof is used for the openable plug. Metallic material exhibiting no or slight reactivity with the molten aluminum, such as Fe or cast steel, can also be used for the openable plug. Parting powder is applied, if necessary, on the openable plug so as prevent reaction with the molten aluminum.

The openable plug 5 (c.f., FIG. 1) is a ground-glass stopper of the inlet and is tapered in the front part. A portion of the openable stopper 5 fitted in the inlet 4 intercepts the upper and lower melt from one another. The shape of an openable plug is not limited to the one described above but may be any one which can close the inlet of the melt. The material of an openable plug is also not limited to the one described above.

When the melt is poured into the space of the main mold, the gas, i.e., air contained in this space, is replaced with the melt. In order to attain smooth replacement, the gas is desirably expelled through the inlet of melt directly into the ambient air. If gas is difficult to expel, the gas should be caused to flow through the inlet 4 into the melt of reservoir 3 and then flow into the ambient air. Therefore, at each time that the openable plug is opened, the melt, which is filling the mold cavity, and the melt, which flows from the melt reservoir, are stirred, with the result that not only cavities, pin holes and micro-shrinkage are incurred. Moreover, since oxides are formed in the melt reserved in the reservoir and contaminates the melt, the defects of oxide inclusions are incurred in an ingot.

If air is confined in the mold, it impedes the formation of an ingot as the mold cavity's contour. Evacuation of air in a mold can be realized by, for example, forming an air-vent between the top and side portions of a mold, facing one another, or in at least the top portion of a mold and, if necessary, in the bottom and side portions of a mold as well as on the surface of a cooling plate where the melt is brought into contact therewith. One or plural air vent may be provided.

Figure 10:
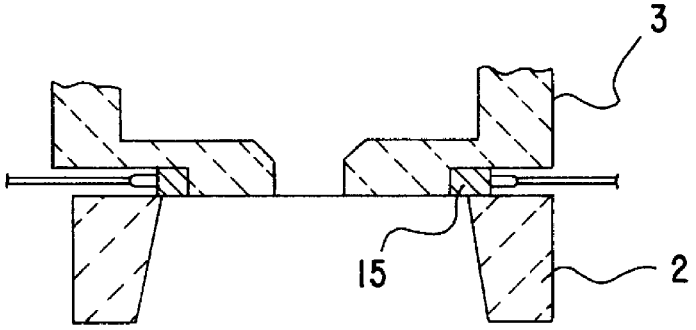
FIG. 10 is a cross-sectional view of a mold provided with an air-vent passage consisting of porous material.
Figure 11:
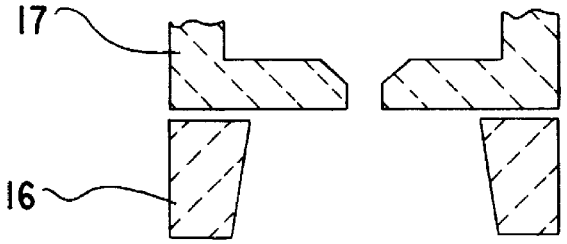
FIG. 11 is a cross-sectional view of a mold which consists of porous material as a whole so as to let the air escape through the porous material.

Molten metal does not penetrate but only air can pass through the air vent, such as realized by the air vent consisting of porous refractory material 15, as shown in FIG. 10, which is fitted in the wall of a mold and is communicated with ambient air. Alternatively, a portion of a mold or the entire mold can be made of porous refractory materials 16, 17, as shown in FIG. 11, such as graphite, SiC, $Si_3N_4$.

Figure 12A:
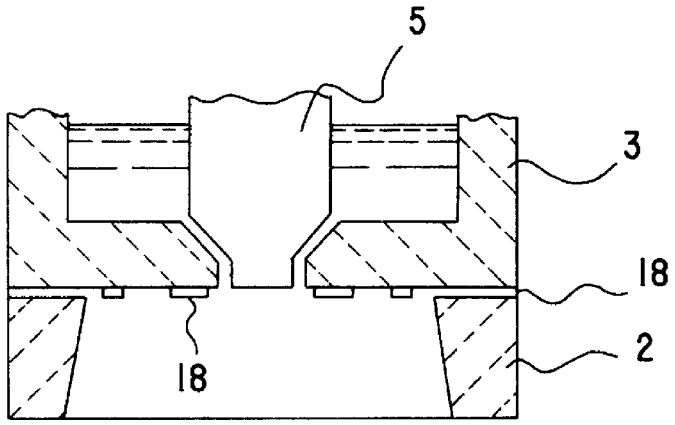
FIG. 12(*a*) shows a mold which is provided with grooves for letting the air escape.
Figure 12B:
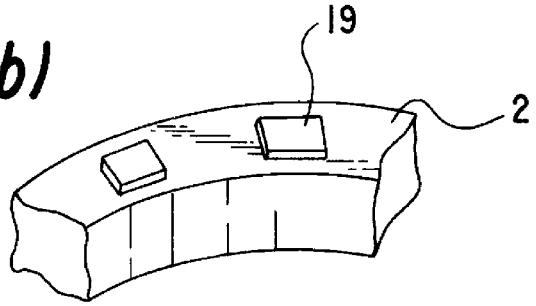

Furthermore, shallow grooves 18 as shown in FIG. 12 may be formed on either or both of the top and side of a mold, which are bonded to form a bonding surface. Thin shims 19 may be sandwiched between the top and side portions of a mold to define the air vent in the form of slits. Thickness of the slits is preferably less than 200 $\mu$m. The slits may be distributed over the entire bonded portion of the mold-top and side portions or may be locally formed on the bonded portion. Distance between the gas vents is also empirically determined depending upon the kind of casting metal, the inner capacity of a mold, and thickness of slits.

Figure 13:
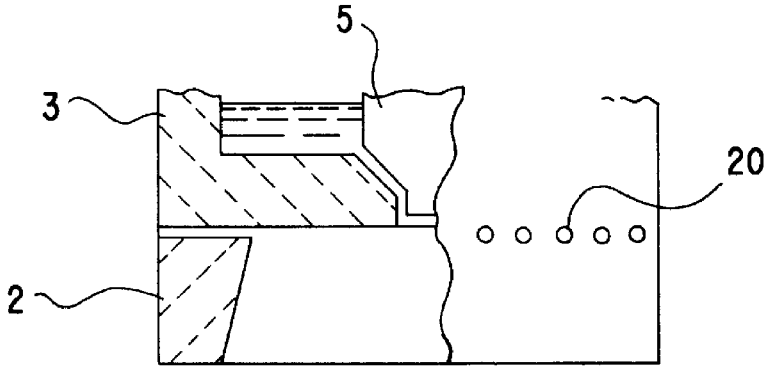
FIG. 13 shows a mold provided with an air-vent in the form of minute apertures.

Alternatively, minute apertures 20 as shown in FIG. 13 and having a diameter of preferably less than 200 um may be formed by means of such mechanical working as drilling and electric forming method such as electric discharge machining. Distance between and the number of the minute apertures 20 are also empirically determined as described above.

Figure 14:
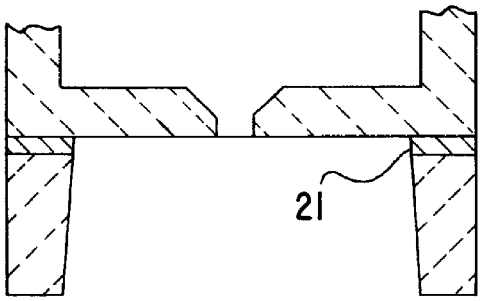
FIG. 14 shows a mold provided with a refractory fiber insert.

An air vent can also be formed by means of sandwiching the refractory-fiber cloth 21 between the mold-top and side portions as shown in FIG. 14. Very thick cloth may be subjected to fiber drawing action of the melt. The refractory-fiber cloth 21, whose fiber is drawn into the melt, loses the refractory property and renders the shape of an ingot unstable. In order to avoid such troubles from occurring, thin refractory fiber cloth 21 is appropriate, and preferable thickness is less than 1 mm. Commercially available refractory cloths of alumina fiber, mixed fibers of $Al_2O_3$ and $SiO_2$, glass fiber, carbon fiber and the like can be used for the refractory-fiber cloth 21.

An air vent can be formed by means of roughening the surface of a cooling plate or the bonding surface of a mold or applying refractory coating agent on such surface. The roughned surface and the refractory agent form minute passages of air.

Figure 15:
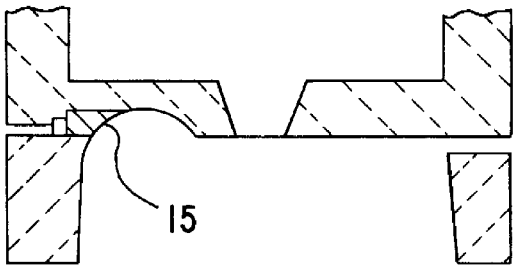
FIG. 15 shows a mold provided with an air reservoir and porous body for passing air.

A mold, in which the ingot according to the present invention is formed, may be provided with an air reservoir (c.f., FIG. 15). In this case, an air vent should be formed in the air reservoir. After the air is expelled form the air reservoir, it is filled with melt.

Prior to filling the mold cavity with the melt, the air in the mold cavity can be replaced with inert gas, such as Ar, $N_2$, He and the like, so as not to form any oxide in the melt being poured during its stirring and hence to further improve the quality of an ingot.

Figure 16:
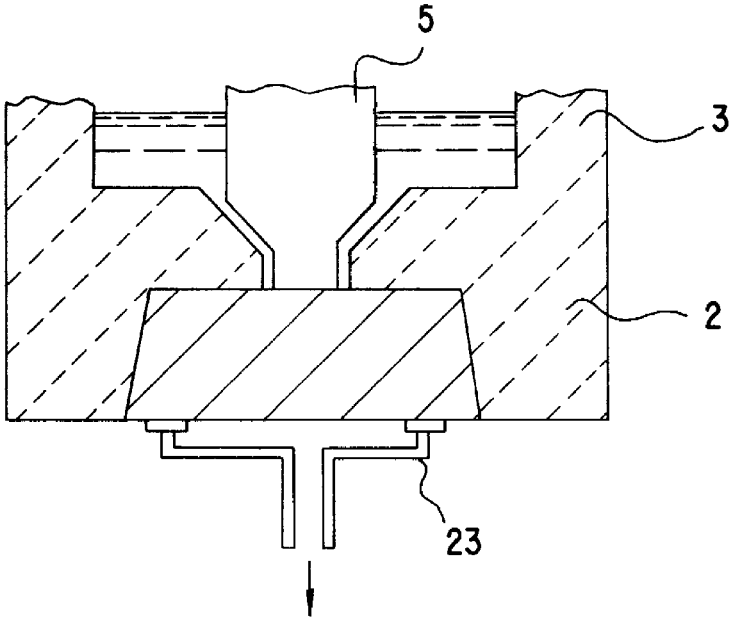
FIG. 16 illustrates a vacuum-evacuating pad fitted on the bottom of an ingot.

In most cases, an ingot in the mold, which has been solidification-shrunk and then thermally shrunk, falls down under gravity. When an ingot is separated from a mold and falls down under gravity, it is supported by a cooling plate or by an exclusive pan for supporting an ingot. The ingot may then be laterally blown out by means of an air nozzle or be brought into contact with a vacuum-evacuating pad 23 as shown in FIG. 16 at the bottom of an ingot, so as to withdraw an ingot from the mold. The vacuum-evacuating pad 23 allows mechanical pulling own of an ingot and hence ensures the withdrawal of an ingot. An ingot may be held in the mold even if the cooling plate is lowered. In this case, the thermal shrinkage of an ingot is not yet satisfactory. Then, the vacuum-evacuating pad 23 is engaged directly beneath the mold so as to suck and withdraw an ingot.

The vacuum-evacuating pad may be provided with a nozzle for injecting the cooling water to an ingot and hence to promote cooling of an ingot. The vacuum-evacuating pad covers the bottom of an ingot and cools the ingot by injecting water and subsequently sucks the ingot so as to withdraw it from a mold.

The vacuum-evacuating pad may be used as a jig for withdrawing an ingot in an emergency case, that is, when an ingot does not smoothly fall down under gravity. The non-falling of an ingot under gravity is detected as an abnormality by means of a photo-sensor or a proximity switch or measuring the weight of a cooling plate.

The vacuum-evacuating pad may also be used to forcedly withdraw an ingot. In this case, the vacuum-evacuating pad is energized in a predetermined step of the casting process.

Typically, the procedure steps of the casting method as described above are as follows.

1) An openable plug is lifted to fill the mold space with melt.
2) The openable plug is closed to intercept the melt.
3) A valve of cooling water is opened to communicate with the cooling plate. The opening of a valve is linked with the measurement of temperature of the cooling plate.
4) The valve is closed and kept closed for a certain time. The closing of the valve is linked with the measurement of temperature of the cooling plate.
5) The cooling plate is lowered.
6) Dropping of an ingot is detected by a sensor.
   6-1) Non-detection (non-dropping of an ingot)
   6-2) The vacuum-evacuating pad is energized to suck an ingot.
   6-3) Lowering
   6-4) Stoppage of sucking
7) An air-nozzle is activated to spray water onto an ingot which is then withdrawn.
8) The cooling plate is lifted and is positioned to form the bottom of a mold.

The present invention is hereinafter described with reference to the examples.

EXAMPLE 1

Forging stocks were cast by using a casting apparatus shown in FIG. 1. An aluminum-alloy was melted in a furnace installed separately from the casting apparatus and was then introduced into the reservoir 3 of the melt. The cooling plate 1 was made of copper sheet. The refractory heat-insulative material used for constructing the main mold, reservoir 3 of the melt and the openable plug 5, was the commercially available (tradename: Lumiboard: the trade name produced by Nichiasu Co., Ltd.). An air vent within the mold was provided by the shims as illustrated in FIG. 12(*b*).

The casting conditions and procedures were as follows.

1) Kind of alloy: JIS 2218 alloy (with no addition of a grain-refining agent)
2) Melt temperature in the reservoir: 720° C.
3) Difference between the level of the top surface of melt in a mold and the level of the melt in the reservoir: 50 mm
4) Temperature of a cooling plate before pouring: 150° C.
5) Rate of cooling water: 5 liters/min
6) Diameter of an inlet for pouring the melt: 12 mmϕ
7) Passage for air vent: 45 μm
8) Temperature of ambient air within the electric furnace 9: 750° C.
9) Temperature of the top portion of a mold and temperature of the top of the side portion of a mold: 680° C.
10) Shape of forging stocks (ingot):
    62.5 mm in diameter and 9 mm in width
    draft 2°
11) Casting procedure:
    pouring—after 2 seconds from the pouring the openable plug was closed.
    cooling plate—water cooling was started, when the temperature reached 500° C.
    cooling plate—water cooling was completed when the temperature falls down to 30° C.
    cooling plate—lowering of the cooling plate when the temperature falls down to 200° C.
12) The ingot falls down under gravity together with the cooling plate.

Figure 17:
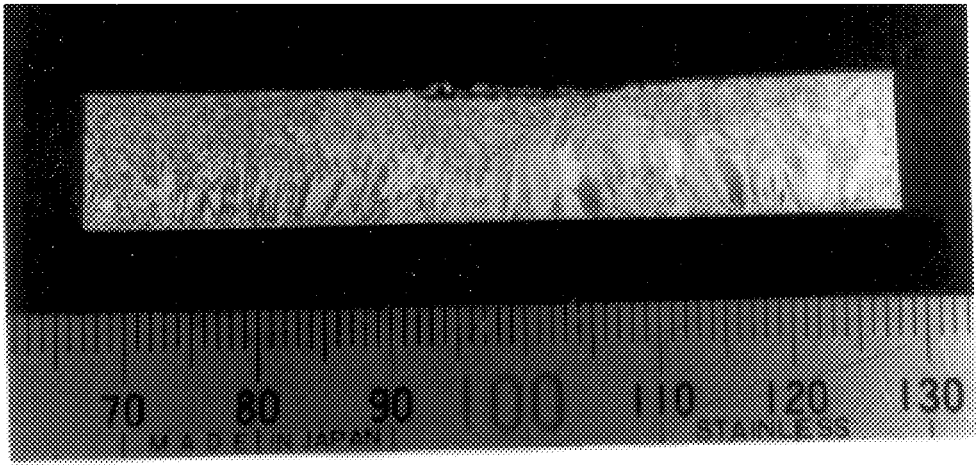
FIG. 17 is a photograph of the macroscopic structure of JIS 2218 alloy (Example 1).

As shown in FIG. 17 of the macroscopic structure, the columnar crystals grew from the bottom of an ingot except for the outermost portion.

Figure 18:
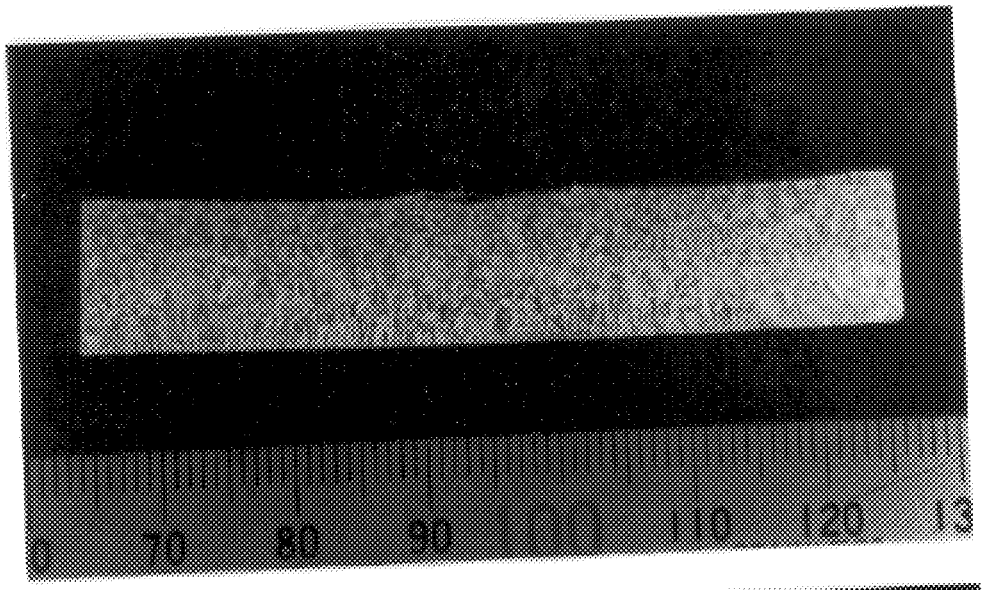
FIGS. 18(*a*), (*b*) and (*c*) are photographs of polar microstructure of the alloy shown in FIG. 17.

Polar microscopic structure of the ingot at its bottom, center and surface portions along the central axis of ingot is shown in FIGS. 18(*a*), (*b*) and (*c*), respectively (magnified by 78 times). The polar crystal size ($d'_1$) shown in FIG. 18(*a*) was 100 μm. The polar crystal size ($d'_2$) shown in FIG. 18(*b*) was 487 μm. Proportion of the area of the structure having the polar crystal size 7 times or less as large as polar crystal size ($d'_1$) was 100%.

The ingots produced by the method as described above were used as forging stocks and cold-forged by a 500-ton forging machine to form cup-form parts (a drum of VTR) having an outer diameter of 63 mm, 50 mm of height and 5 mm of thickness. Before the forging, annealing was carried out at 390° C. for 4 hours. Lubricating oil for forging (Bondalube liquid (trade name) produced by Nihon Parkerizing Co., Ltd.) was used to form a lubricating film.

EXAMPLE 2

Figure 3A:
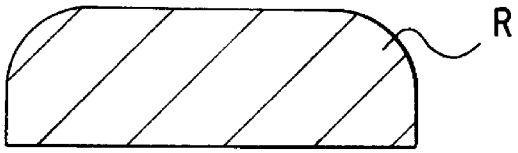
Fig.3(a) PRIOR ART
FIG. 3 (*a*) shows an ingot obtained by the apparatus shown in FIG. 2 and FIG. 3 (*b*) shows a forging stock obtained by extruding and then cutting the ingot.
Figure 3B:
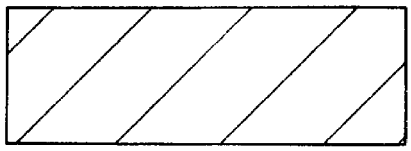
Fig.3(b) PRIOR ART
Figure 4:
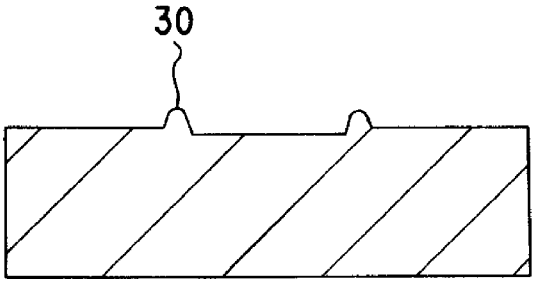
FIG. 4 illustrates that a sprue configuration remains on the surface of an ingot.
Figure 5A:
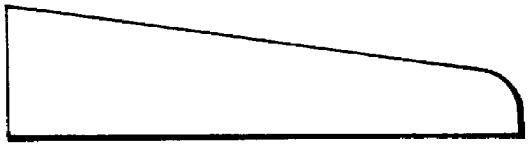
FIGS. 5(*a*) through (*e*) illustrate examples of the shape of ingots according to the present invention.
Figure 5B:
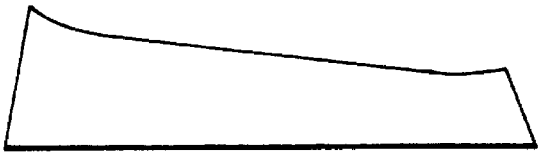
Figure 5C:
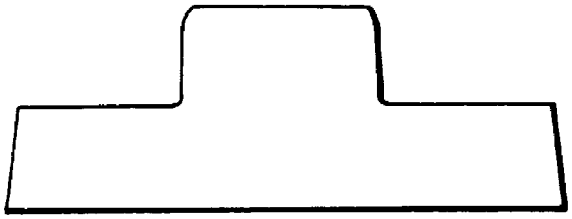
Figure 5D:
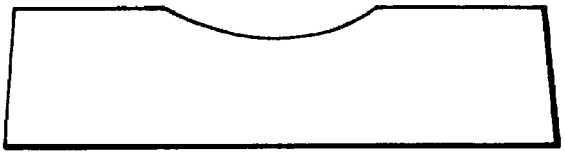
Figure 5E:
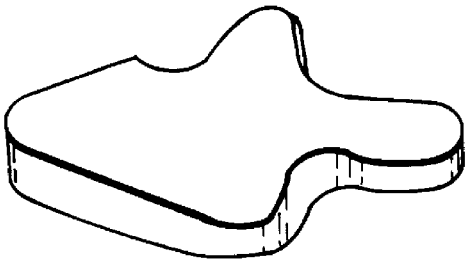

In order to investigate how the height of melt level in a feed reservoir was effective in filling the melt into the mold, casting was carried out while changing the level difference (H) between the inner surface of the top portion of a mold and the level of the melt in the reservoir upon completion of pouring. The other conditions were the same as in Example 1. As a result, a relationship was obtained between the shape of top corner of the resultant ingots (meniscus radius R shown in FIG. 3) and the level difference as shown in Table 1. It was confirmed that the mold was filled with melt when the level difference was 20 mm or more.

TABLE 1

| H (mm) | R (mm) |
|---|---|
| 10 | 5 |
| 20 | 1 |
| 40 | 0 |
| 70 | 0 |

COMPARATIVE EXAMPLE 1

The same forging stocks as in Example 1 were produced by the following casting process, followed by an extrusion process, and were forged.

1) Kind of material: JIS 2218 alloy
2) Continuous casting: billet 200 mm in diameter
3) Homogenizing treatment of a billet: 500° C. for 16 hours 4) Extrusion: 64 mm in diameter
5) Drawing: 62.5 mm in diameter
6) Annealing: 390° C. for 4 hours
7) Cutting (disc saw): 9 mm in thickness
8) Forging: the same as in Example 1

COMPARATIVE EXAMPLE 2

The same forging stocks as in Example 1 were produced by the following process and then forged.

1) Kind of material: JIS 2218 alloy
2) Continuous casting: a small-diameter bar 700 mm in size
3) Homogenizing treatment and annealing of a billet: 500° C. for 16 hours and 390° C. for 4 hours
4) Machining of the outer surface: 62.5 mm in diameter
5) Cutting (disc saw): 9 mm in thickness
6) Forging: the same as in Example 1

The results of Example 1 and Comparative Examples 1 and 2 are shown in Table 2.

TABLE 2

| | Weight dispersion of forging stocks (g) | Thickness dispersion of bottom of forged product (mm) | Production yield of forging stocks (%) |
|---|---|---|---|
| Example 1 | 75 ± 0.4 | 50 ± 0.05 | 97 |
| Comparative Example 1 | 75 ± 1.3 | 50 ± 0.15 | 80 |
| Comparative Example 2 | 75 ± 1.3 | 50 ± 0.15 | 75 |

In Example 1, the pouring was highly accurate, and the so-produced forging stocks attained very small dispersion of thickness of forged product. The production yield of forging stocks in Table 2 was the weight of ingots obtained by lowering the cooling plate at 200° C., relative to the weight of starting material in the case of Example 1 and the weight of forging stocks obtained by cutting relative to the weight of starting material in the case of Comparative Examples 1 and 2. The cutting accuracy by a disc saw was ±0.15 mm in the case of Comparative Examples 1 and 2.

COMPARATIVE EXAMPLE 3

Figure 2:
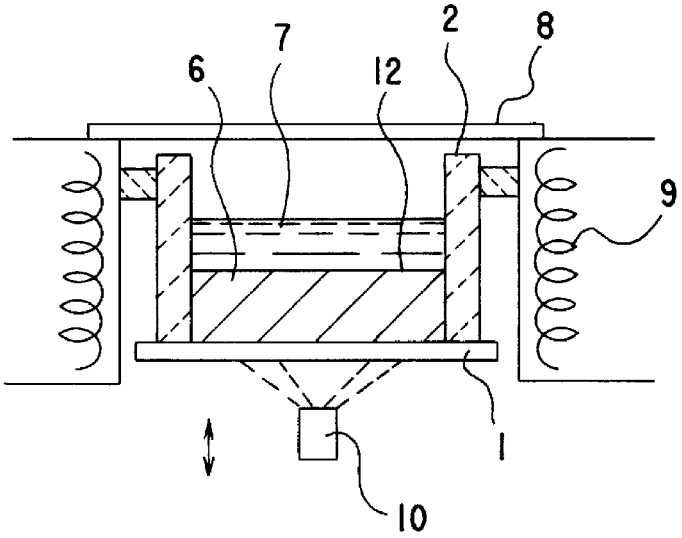
Fig.2 PRIOR ART
FIG. 2 is a general cross-sectional view of a conventional casting apparatus for unidirectional solidification.

The apparatus shown in FIG. 2 was used to produce ingots. The upper surface of melt within the mold was open and free. The melt was weighed (75 g) by a shank and poured into a mold. The other conditions were the same as in Example 1. The resultant ingots were forged as in Example 1. The results are shown in Table 3 together with those of Example 1.

TABLE 3

| | Forging Stocks | | | | | Forged Product | |
|---|---|---|---|---|---|---|---|
| | Meniscus (R) (mm) | Dispersion of Weight (g) | Inner quality | Productivity cycle time (sec per product) | Automation | Forgeablity | Dimension accuracy at bottom (mm) |
| Example 1 | 0 (non curve) | 75 ± 0.4 | no defects | 15 | Easy | no trouble | 5 ± 0.05 |
| Comparative Example 3 | 20 | 75 ± 10 | oxides cavities | 75 | Difficult | cracking of dies stopping of machine | * |

Remarks: the asterisk mark indicates that data are difficult to obtain. Locally thin product, not meeting the required thickness.

EXAMPLE 3

The same casting method as in Example 1 was repeated except that JIS alloy 2218 with addition of Al—5%Ti—1%B was cast. In the bottom of the resultant ingots columnar crystals were grown as shown in the macroscopic structure of FIG. 19. The meniscus radius of the resultant ingots was 0.1 mm. Polar microscopic structure of the ingots at its bottom, center and surface portions along the central axis of ingots was observed. The polar crystal size ($d'_1$) of forcedly cooled, structure was 72 $\mu$m. The polar crystal size ($d'_2$) in the top of an ingots was 140 $\mu$m. Proportion of area of the structure having the crystal grain size 7 times or less as large as polar grain size ($d'_1$) is 100%.

EXAMPLE 4

Figure 20:
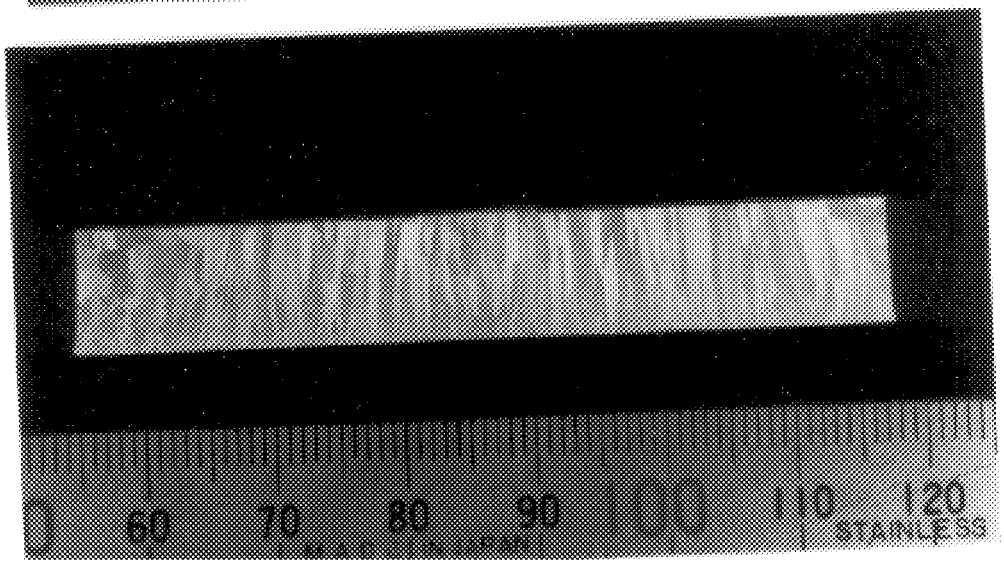
FIG. 20 is a photograph of the macroscopic structure of JIS 6061 alloy (Example 4).
Figure 18A:
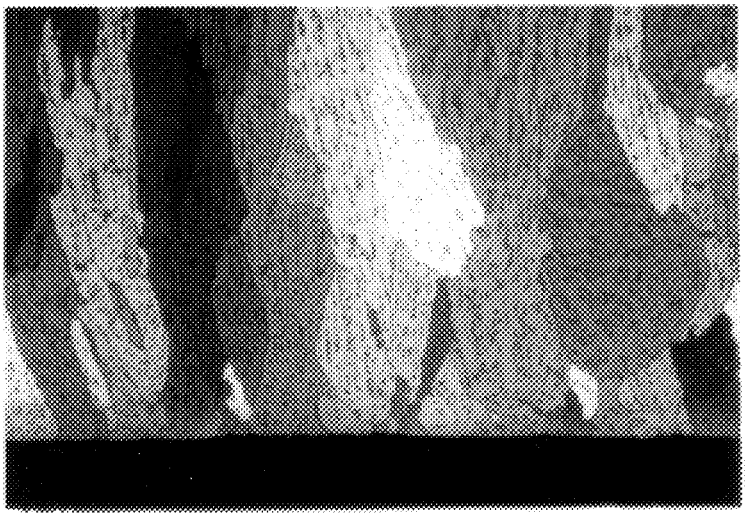
Figure 18B:
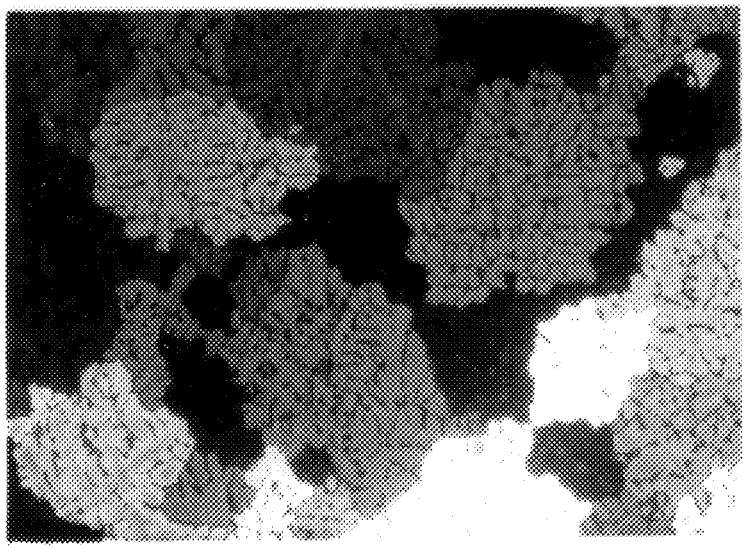
Figure 18C:
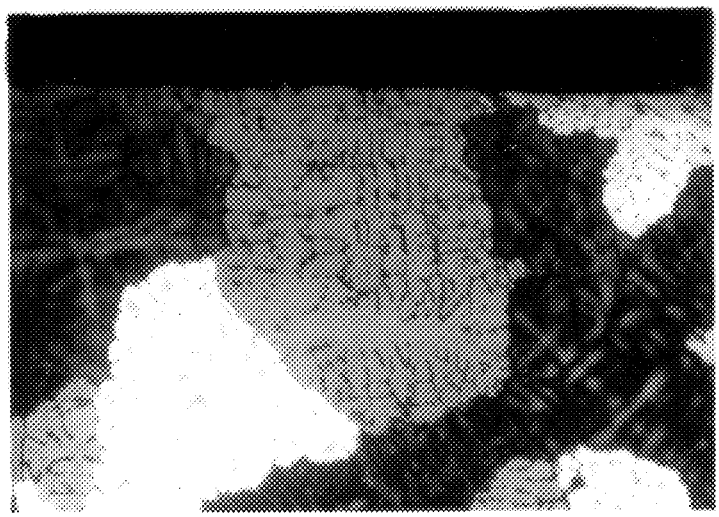

Instead of JIS 2218 alloy used in Example 1, JIS 6061 alloy was cast under the same conditions as in Example 1. Almost all the ingots consisted of columnar macroscopic structures except for the 5 mm thick side surface of an ingot (c.f., FIG. 20). The meniscus radius of the ingots was 0.2 mm.

EXAMPLE 5

Figure 21A:
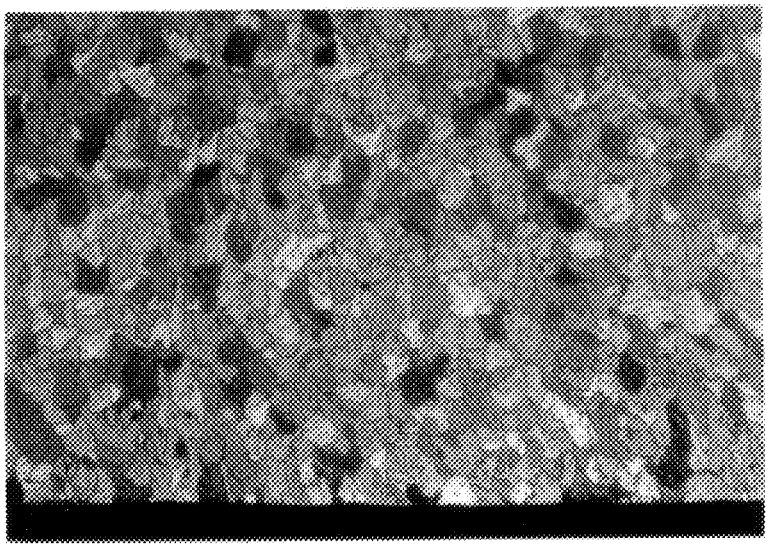
FIGS. 21(*a*), (*b*) and (*c*) are photographs of the polar microscopic structure of JIS 6061 alloy (Example 5).
Figure 21B:
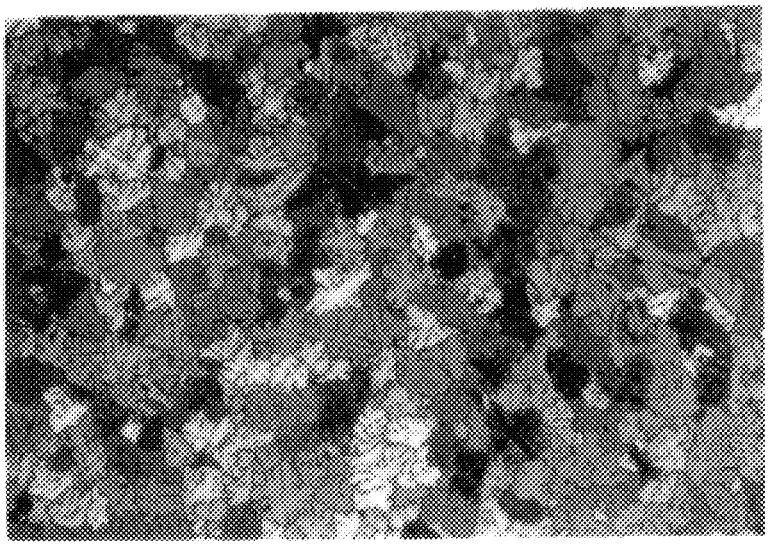
Figure 21C:
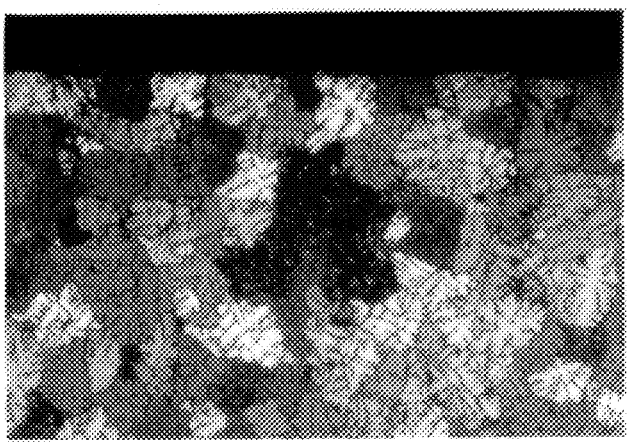

The same casting method as in Example 1 was repeated except that JIS 6061 alloy with addition of Al—5% of Ti—1% B alloy was cast. The resultant ingots entirely consisted of equi-axed crystals and had 0.3 mm of meniscus radius (c.f. FIG. 21).

Polar microscopic structure of the ingots at its bottom, center and surface portions of the ingots, which portions being distant from the surface by a half of the radius, is shown in FIGS. 21(*a*), (*b*) and (*c*), respectively. In FIG. 21(*a*), a group of the polar microscopic grains in contact with the bottom of ingots is counted as the first row, then, another group of the macroscopic grains in contact with the first row is counted as the second row. Similarly, another group is counted as the third row. In the crystal grains up to the tenth row, the oriented growth is recognized. The polar crystal size ($d'_1$) on the forcedly cooled surface shown in FIG. 21(*a*) is 13.9 μm in average. The polar crystal-size ($d'_2$) on the forcedly cooled surface shown in FIG. 21(*c*) is 88.4 μm in average. Proportion of the crystals from 1.05 to 7 times as large as the polar grain size ($d'_1$) is 100% by area.

Results of measurement of average DAS obtained by the crossing method (five lines are drawn parallel to the forcedly cooled surface shown in the microscopic photograph and numbers intersecting the dendrite arms are counted, unit-μm) are shown below.

| | |
|---|---|
| Periphery, top | 25.8 |
| Periphery, center | 27.8 |
| Periphery, bottom | 23.7 |
| Intermediate, top | 29.3 |
| Intermediate, center | 28.5 |
| Intermediate, bottom | 18.4 |
| Center, top | 33.9 |
| Center, center | 26.6 |
| Center, bottom | 24.2 |

As is clear from above, the forced cooling exerts an effect from the bottom to the top surface of an ingot, but its effect is lessened in the periphery of an ingot due to the cooling by the mold side-wall. In addition, when the average value of three DAS values at the bottom is used as the DAS of the forced cooled surface, then, the proportion of the structure having from 1.1 to 7 times the DAS mentioned above was calculated to be 100% by area.

EXAMPLE 6

Instead of JIS 2218 alloy used in Example 1, JIS 4032 alloy without the grain-refining agent was cast under the same conditions as in Example 1. The macroscopic structure of the resultant ingots was a columnar structure from the bottom up to a quarter thickness of the ingots. The meniscus radius of the ingots was 0.3 mm.

The DAS (μm by the secondary arm method for measuring the distance between the secondary arms) was measured as in Example 5, and the following results (μm) were obtained.

| | | DAS (μm) | Ratio relative to DAS at bottom |
|---|---|---|---|
| Periphery, | top | 13.2 | 3.87 |
| Periphery, | center | 13.9 | 3.56 |
| Periphery, | bottom | 3.9 | 1 |
| Intermediate, | top | 13.9 | 3.38 |
| Intermediate, | center | 11.5 | 2.74 |
| Intermediate, | bottom | 4.2 | 1 |
| Periphery (b), | top | 8.4 | 2.32 |
| Periphery (b), | center | 12.4 | 2.10 |
| Periphery (b), | bottom | 5.9 | 1 |

The proportion of structures having DAS as large as from 1.1 to 7 times DAS the forced cooled structure was 100% by area.

Figure 22:
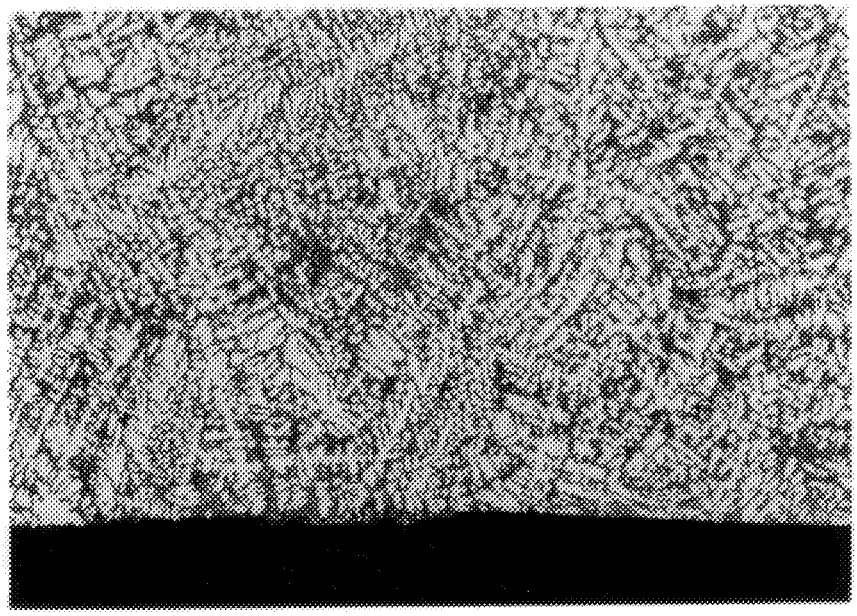
FIG. 22 is a photograph of metal microscope structure of JIS 4032 alloy.
Figure 23:
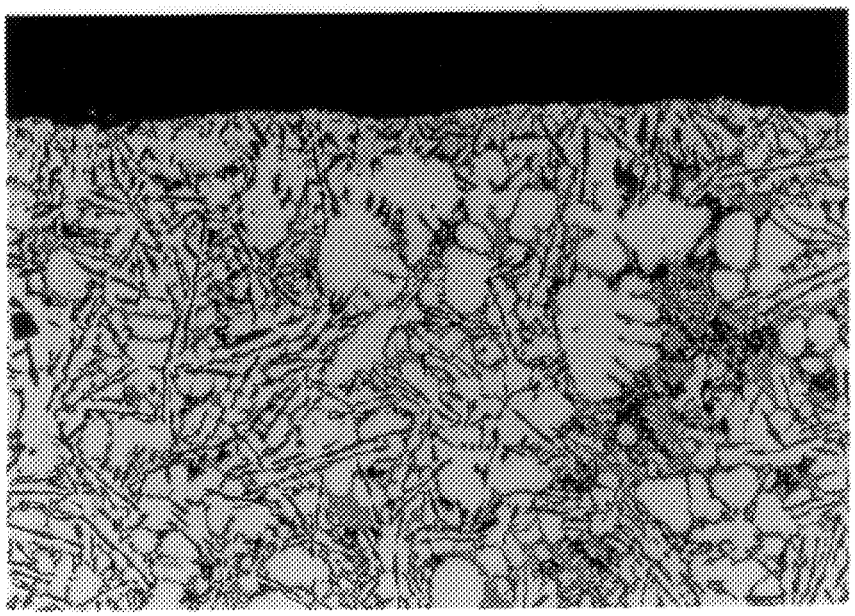
FIG. 23 is a similar photograph to FIG. 22.

In FIG. 22 is shown a micro-structure of the inter-mediate bottom, where the effect of forced cooling is the highest, and whose DAS is 4.2 μm. In FIG. 23 is shown a micro-structure of the central top, where the effect of forcedly cooling is the lowest, and whose DAS is 4.2 μm. These structures shown in FIGS. 22 and 23 correspond to the DAS values.

As is described hereinabove, the ingots according to the present invention are produced at low cost, have improved internal qualities over those of conventional castings and die-cast product and has improved forgeability. The ingots according to the present invention have low dispersion of weight. Since the ingots according to the present invention have excellent properties as described above, they can substitute for a continuous cast bar and its extruded bar which has been the main forging stocks up to this time.

moreover, the ingots according to the present invention can be subjected to such plastic working as forming by an impactor, forming by rolling, and the like.

We claim:

1. A method for producing a metallic ingot for plastic working, comprising the steps of:

locating a main mold on a cooling plate and a melt reservoir above the main mold;

filing the main mold with a metallic melt from the melt reservoir through a sprue of the main mold without leaving a clearance in the mold;

closing the sprue by an openable plug thereby forming a portion of the mold by a front end of the openable plug; and cooling the cooling plate so as to forcedly cool the metallic melt to produce the metallic ingot.

2. A method for producing a metallic ingot for plastic working according to claims 1, further comprising a step of evacuating gas in the mold through an air vent.

3. A method for producing a metallic ingot for plastic working according to claim 1, wherein said forced cooling by the cooling plate is carried out by at least growing a solidified shell with a thickness that said solidified shell is not broken out by directly applying water onto a surface of the ingot.

4. A method for producing a metallic ingot for plastic working according to claim 3, further comprising steps of:

withdrawing the cooling plate when the solidified shell grows so thick that it is not broken out by directly applying water onto a surface of the ingot; and, applying cooling water directly onto said surface.

* * * * *